US010265968B2

(12) United States Patent
Holike et al.

(10) Patent No.: US 10,265,968 B2
(45) Date of Patent: Apr. 23, 2019

(54) LABEL PRINTER FOR LINERLESS LABELS

(71) Applicant: Mettler-Toledo (Albstadt) GmbH, Albstadt (DE)

(72) Inventors: Walter Holike, Geislingen (DE); Albert Gerstenecker, Messstetten (DE)

(73) Assignee: METTLER-TOLEDO (ALBSTADT) GMBH, Albstadt (DE)

( * ) Notice: Subject to any disclaimer, the term of this patent is extended or adjusted under 35 U.S.C. 154(b) by 7 days.

(21) Appl. No.: 15/784,732

(22) Filed: Oct. 16, 2017

(65) Prior Publication Data

US 2018/0126757 A1 May 10, 2018

(30) Foreign Application Priority Data

Nov. 8, 2016 (EP) ..... 16197658

(51) Int. Cl.

| | |
|---|---|
| ***B41J 11/70*** | (2006.01) |
| ***B41J 3/407*** | (2006.01) |
| ***B41J 15/04*** | (2006.01) |
| *G09F 3/10* | (2006.01) |
| *G09F 3/02* | (2006.01) |

(52) U.S. Cl.

CPC ..... *B41J 3/4075* (2013.01); *B41J 11/70* (2013.01); *B41J 11/703* (2013.01); *B41J 15/04* (2013.01); *B41J 15/048* (2013.01); *G09F 3/10* (2013.01); *G09F 2003/0201* (2013.01); *G09F 2003/0229* (2013.01)

(58) Field of Classification Search

CPC ..... B41J 11/70; B41J 3/4075; B41J 15/04

See application file for complete search history.

(56) References Cited

U.S. PATENT DOCUMENTS

| | | | | |
|---|---|---|---|---|
| 6,357,941 | B1 * | 3/2002 | Amano | B41J 3/4075 400/613 |
| 2005/0139323 | A1 | 6/2005 | Syde et al. | |
| 2009/0116893 | A1 * | 5/2009 | Furuki | B41J 3/54 400/621 |
| 2016/0114596 | A1 * | 4/2016 | Komai | B41J 3/4075 347/110 |
| 2017/0173979 | A1 * | 6/2017 | Hoshi | B41J 2/32 |
| 2017/0217705 | A1 * | 8/2017 | Hoshi | B65H 7/06 |

FOREIGN PATENT DOCUMENTS

JP 2015-221487 A 12/2015

* cited by examiner

*Primary Examiner* — Kristal Feggins
*Assistant Examiner* — Kendrick X Liu
(74) *Attorney, Agent, or Firm* — Standley Law Group LLP; Jeffrey S. Standley; Stephen L. Grant

(57) ABSTRACT

A linerless label is printed and separated from a ribbon (7) of the labels by a label printer (1, 1') having a printing unit (2, 2'), a holder (6) for the linerless label ribbon, a cutting unit (3) and a paper-feeding unit (8, 8'). The paper-feeding unit advances the linerless label ribbon through the printing unit and the cutting unit. The printing unit prints a part of the linerless label ribbon as it is advanced. The printed linerless label (9) is separated from the linerless label ribbon by the closing of at least two blades (4, 5) arranged on the sides of the linerless label ribbon. Afterward, the blades return to an open starting position for a next cutting operation. Before the blades open, the linerless label ribbon is pulled back from the blades, creating a distance (z) between the linerless label ribbon and the blades).

10 Claims, 4 Drawing Sheets

LABEL PRINTER FOR LINERLESS LABELS

CROSS-REFERENCE TO RELATED APPLICATIONS

This application is entitled to benefit of a right of priority from European application 16 197 658.4, filed on 8 Nov. 2016, which is incorporated by reference as if fully recited herein.

TECHNICAL FIELD

The invention concerns a method for a label printer to print and separate linerless labels.

BACKGROUND

Label printers are frequently used together with an inspection device such as for example a weighing scale. This combination is widely used in retail stores, where the customers themselves place their purchases (vegetables, fruits, meat, etc.) on the scale and weigh them. After a number associated with the respective merchandise has been entered, the scale calculates the price for the weighed amount and causes the attached label printer to print the price label.

The field of label printers can be divided into different types according to the kind of label being used. On the one hand, there are labels that are adhesively connected to a carrier foil from which they are separated after the printing and delivered through a label output slot. The customer takes the label from the printer and sticks it on the merchandise to be identified. Labels of this type are necessarily of a uniform size, whereby the area available for printing is predetermined. After the label has been separated from the carrier foil, the latter has to be rolled up again, a function that is performed in most cases in the label printer itself. Labels of this type have the further disadvantage that exchanging or loading a new label roll is complicated and that special measures are necessary to detect the label on the carrier foil and to synchronize the paper-feeding mechanism with the print unit accordingly.

The need to overcome the drawbacks of a carrier foil led to the development of linerless labels, which can be described as label paper that is coated on one side with an adhesive. In contrast to labels on carrier foils, this linerless type of label requires a cutting unit to separate the printed linerless label from the unprinted linerless label paper ribbon. The contact between the blades of the cutting unit and the label paper can leave residual amounts of adhesive remaining on the blades which, over time, can affect the cutting performance. This can lead to unclean cuts, or the cutting unit can even jam up.

According to the present state of the art, two solutions are known to counteract the tendency of the blades getting stuck. One solution is to apply the adhesive coating not as a continuous layer on the label paper, but to leave uncoated gaps which are used to separate the labels at the respective locations. This has the disadvantage that the size of the label is again predetermined, as the label is always cut at the next-following gap of the adhesive. Depending on the interval of adhesive area and uncoated gap, the length of label paper used can be more for one label and less for another, but normally it is always larger than necessary. In addition, it is necessary to establish synchronization between the feed mechanism and the cutting unit, so that the cutting occurs only at the locations of the uncoated gaps. This is accomplished in most cases through markings on the linerless label ribbon. However, the manufacturing cost for the label paper is enormously increased by the process of applying the markings and the adhesive coating with the uncoated gaps.

Also known is a type of label paper that does not carry a full-surface coating of adhesive but where the adhesive is applied in a pattern of coated and uncoated areas. Such patterns can be analogous to a line-hatching, for example narrow stripes running at about 45° across the linerless label ribbon, as well as crossed or V-shaped stripes.

According to another solution presented in EP 1 621 465 A2 or JP 2015 221 487 A1, the blades are moistened with an oil which reduces the tendency of adhesive to stick to the blades. At least one of the blades is immersed in an oil bath or is wiped over an oil-soaked pad whereby the blade is moistened with oil. This has the obvious drawback that oil residues remain on the label after its separation from the ribbon, which is on the one hand detrimental to the adhesive bond between the label and the attachment area (the label can be peeled off more easily), while on the other hand it is deemed unacceptable for the customers to get oil on their fingers.

The object of the embodiments disclosed here is to provide a method which overcomes the drawbacks of the state of the art, specifically a method which allows the label to be separated at any desired place without causing a degradation of cutting performance of the blade or the label printer, and without requiring the blades to be wetted with oil.

SUMMARY

This task is solved by a method in accordance with the appended claims.

The method of printing and separating linerless labels with a label printer, wherein the latter includes a printing unit, a holder for the linerless label ribbon, a cutting unit with at least two blades arranged, respectively, on the two sides of the linerless label ribbon, and a paper-feeding unit, performs at least the following steps. By means of the paper-feeding unit, the linerless label ribbon is advanced through the printing unit and through the cutting unit. During the feed advancement, printing takes place on a part of the linerless label ribbon by means of the printing unit. When the printing is finished, the printed linerless label is separated from the linerless label ribbon by means of the blades closing against each other. A subsequent movement of the blades away from each other returns the blades to a starting position for a next cutting operation.

According to the invention, the step of the blades moving away from each other is preceded by a movement of the linerless label ribbon being pulled back from the blades. This creates a distance between the linerless label ribbon and the blades.

An analysis of the problem of adhesive sticking to the blades has shown that in the parting of the blades the unprinted linerless label ribbon wipes over the blade, whereby the adhesive gets on the blades. Pulling the ribbon back before the return movement of the blades to the starting position for the next cutting operation proves to be an effective way of preventing the adhesive from sticking to the blades. The inventive method thus meets the objective of an undiminished cutting performance.

The method further accomplishes an economic use of label paper as the cut does not have to be made farther away than necessary and also the printing on the next label can be started closer to the cut at the leading end of the unprinted linerless label ribbon.

In a further development of the inventive method, the parting of the two blades occurs as soon as the linerless label ribbon is out of contact with the blades. This shortens the time for carrying out the method as two steps are performed simultaneously.

In a further development of the inventive method, the printing unit has a print head wherein the maximum distance of the linerless label ribbon from the blades after the pulling back equals the distance between the print head and the blades.

The inventive method can in addition be distinguished by the feature that in the cutting operation the two blades of the cutting unit sever the linerless label ribbon across its entire width.

In an additional further developed version of the method, the two blades of the cutting unit are set at an acute angle to each other and are contacting the linerless label ribbon between them only in a point during the cutting process. The blades may for example perform a translatory movement during the cutting process. This additionally extends the useful life of the blades and reduces the accumulation of adhesive residues. Also, the amount of force required to cut through the linerless label ribbon is smaller.

In another further developed version of the method, the label printer additionally includes a receiving element with a sensor onto which a linerless label falls after it has been cut. Under the control of the sensor signal, a following linerless label is released for delivery only if no linerless label is present on the receiving element. This serves to prevent that two linerless labels stick to each other.

In one version, one of the two blades is solidly connected to the label printer, while the other blade is arranged to be movable relative to the label printer. Furthermore, the stationary blade can be arranged close to the receiving element, so that after the closing of the blades against each other the stationary blade lies between the movable blade and the receiving element.

In a further embodiment, the movable blade is arranged on the forward-facing side of the stationary blade relative to the output direction of the linerless label.

In a computer-assisted program for the implementation of the method to print and separate linerless labels, a signal is generated which serves to trigger a pulling-back movement of the linerless label ribbon. The label printer for carrying out the method includes a printing unit, a cutting unit with at least two blades, a holder for the linerless label ribbon, and a paper-feeding unit.

BRIEF DESCRIPTION OF THE DRAWINGS

The inventive method and its implementation in a label printer are explained in detail with the help of the following drawing figures, wherein elements that are identical from one figure to another carry the same reference symbols, and wherein.

DETAILED DESCRIPTION OF THE DISCLOSED EMBODIMENTS

Figure 1:
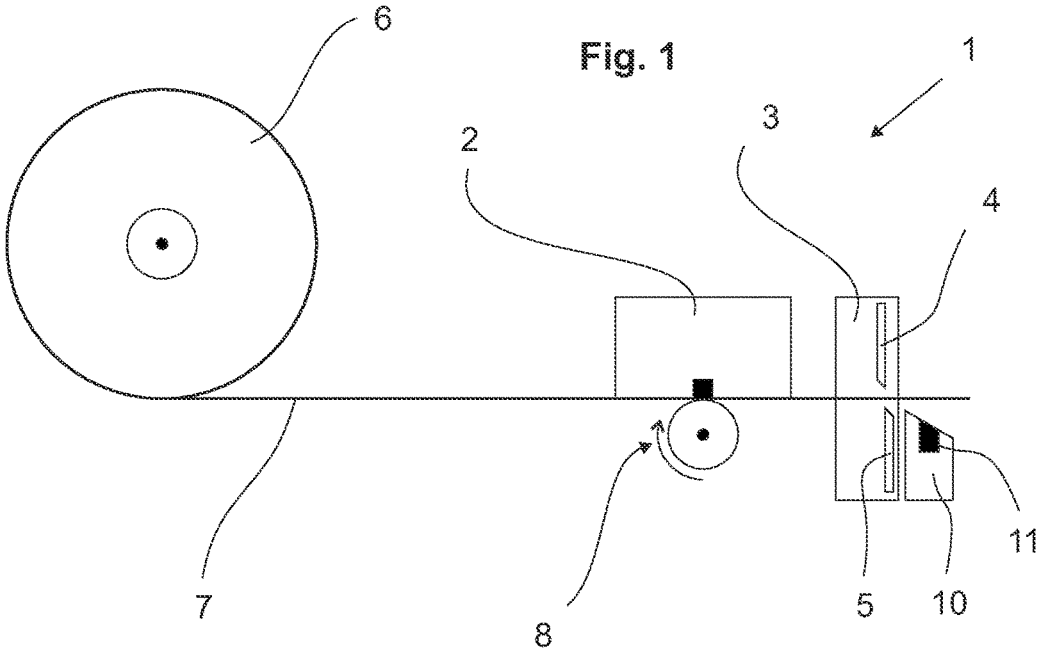
FIG. 1 shows a label printer in the process of printing and advancing the linerless label ribbon.

FIGS. 1 to 4 show a label printer performing the steps of the method of printing and separating linerless labels. The label printer is represented only schematically, as the specific design configuration is of no relevance. The illustrated label printer 1 includes a printing unit 2, a cutting unit 3 with at least two blades 4 and 5, a holder 6 for a roll of the linerless label ribbon 7, and a paper-feeding unit 8. The label printer 1 can additionally include a receiving element 10 with a sensor 11. The printing unit is arranged above the paper-feeding unit 8, wherein the paper-feeding unit 8 is in this case simultaneously combined with the print roller. The paper-feeding unit can also include more rollers than are shown in FIG. 1. The black square within the printing unit 2 represents the location of the printing process (print head).

The word "forward" in the present context means the sense of direction of the label delivery. In FIGS. 1 to 4 this means from left to right as seen by a viewer of the drawings. "Forward" in each of the drawings is the direction in which the end of the linerless ribbon 7 is pointing. Since the aforementioned components are enclosed inside a housing of the label printer, the area after the blades 4 and 5 is considered as outside, and the area before the blades is considered as inside, with the cutting unit being, of course, arranged inside the housing.

In FIGS. 1 to 4 and 6, the blade 5 is shown as stationary and, in the closed position of the blades 4, 5, arranged between the receiving element 10 and the movable blade 4.

FIG. 1 shows a label printer 1 in the process of printing on the linerless label ribbon 7. The print head of the printing unit 2, represented by the black square, symbolically indicates the location where the printing takes place. With a steady feed movement as indicated by the circular arrow, one line after another is printed onto the linerless label ribbon 7 by means of the paper-feeding unit 8. The printed information may have been transmitted for example by a weighing scale (not shown) to the label printer 1. After the printing has been completed, the linerless label ribbon 7 is brought into the position in which the linerless label is to be separated from the linerless label ribbon 7.

Figure 2:
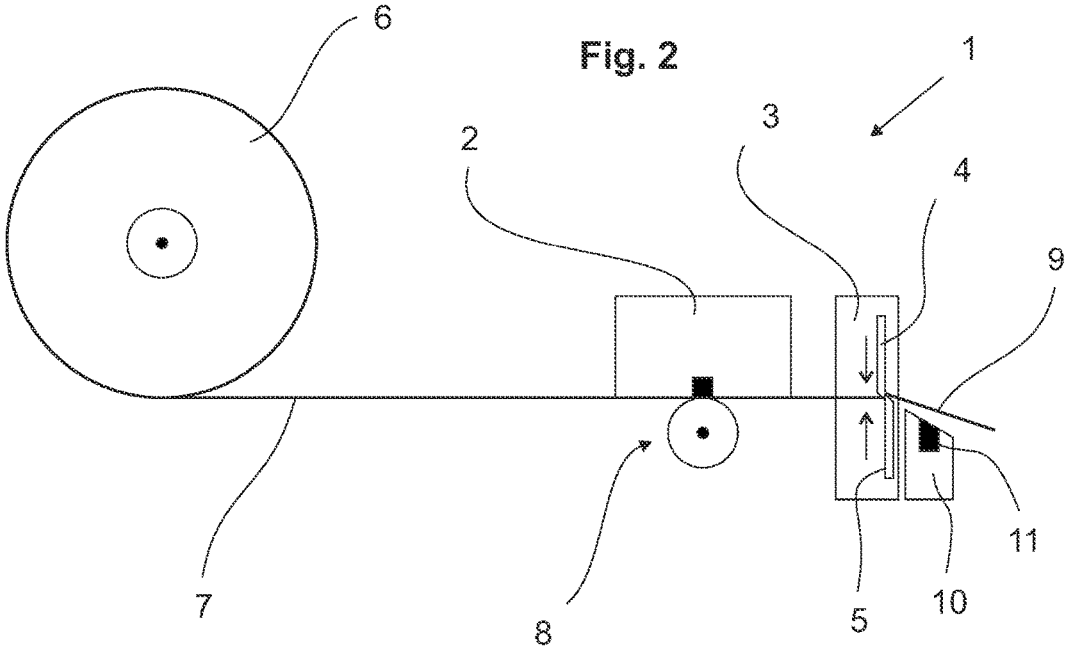
FIG. 2 shows a label printer in the process of separating the linerless label from the linerless label ribbon.

In FIG. 2, the linerless label 9 is being separated from the linerless label ribbon 7 at a single point across an entire width thereof by the cutting unit 3 with the two blades 4 and 5 of the cutting unit 3 moving against each other as indicated by the two arrows to the left of the blades 4 and 5. The linerless label 9 is now no longer connected to the linerless label ribbon 7 and sticks out on the outside of the label printer 1 so that it can be taken off. The linerless label ribbon 7 is now in contact with the blade 5 on the inside.

Figure 3:
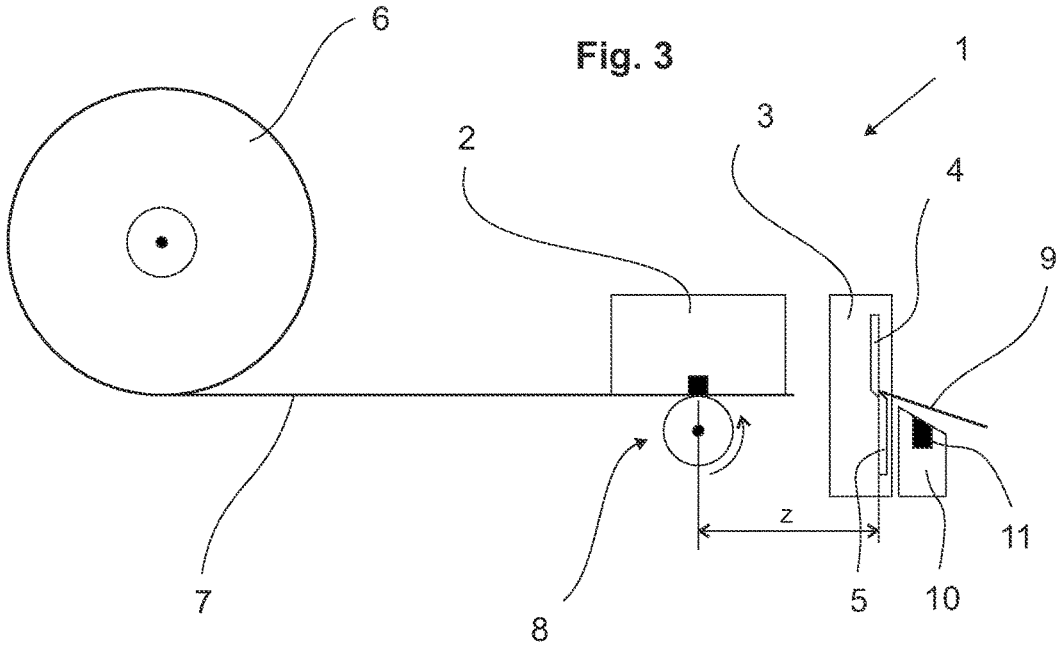
FIG. 3 shows a label printer in the process of pulling back the linerless label ribbon from the blades of the cutting unit.

In the step that distinguishes the invention, the linerless label ribbon 7 is now pulled back by a certain amount as shown in FIG. 3. This creates a distance z between the leading end of the linerless label ribbon 7 and the surface of the blade 5 that faces towards the interior of the housing. Consequently, the linerless label ribbon 7 is no longer in contact with the blade 5. To create the distance z, the paper-feeding unit 8 is operated in the reverse direction compared to printing. It has been found that even a small distance z—just enough that the linerless label ribbon 7 no longer touches the blade 5—is sufficient to prevent residues of adhesive from adhering to the blade. The maximum distance z from the blade 5 is limited only by the position of the printing unit 2 in relation to the cutting unit 3, i.e. how far the linerless label ribbon can be pulled back so that a new printout can be started.

In regard to the pulling back, care should be taken that the linerless label ribbon 7 does not leave its guide track. The maximum distance z has been reached when the linerless label ribbon 7 is pulled back to the print head of the printing unit 2. Expressed in numbers, the distance z is 0.5 to 5 cm.

Figure 4:
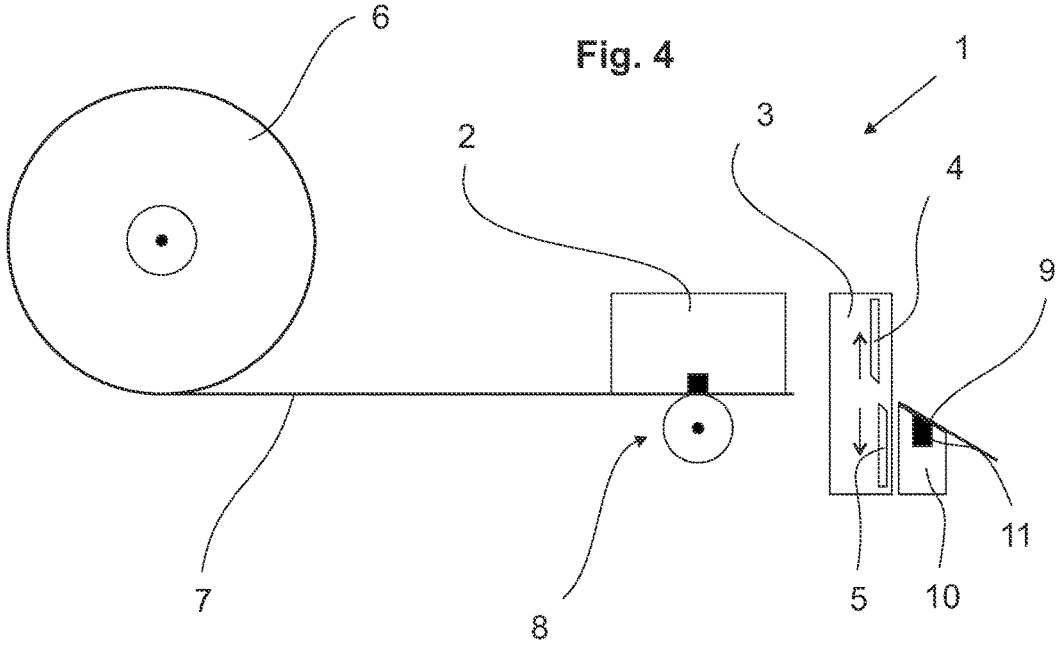
FIG. 4 shows the label printer with the blades of the cutting unit in the process of moving away from each other.

FIG. 4, finally, shows the blades 4 and 5 being moved away from each other, as indicated again by the two arrows to the left of the blades 4 and 5. The cut-off linerless label 9 can now be attached to the object that is to be labeled. A delivery of a new linerless label can now begin. As is evident from FIG. 4, the printout on the new label can start closer to the cut-off end of the not yet printed linerless label ribbon 7. Thus, the method is conducive to an economical use of label paper.

If the printed linerless label 9 is not taken away by the user, it will fall onto a receiving element 10. A sensor 11 detects if a linerless label 9 is present on the receiving element 10. The signal of the sensor 11 can be used to prevent that a subsequent delivery of a linerless label begins before the last printed linerless label 9 has been removed. This arrangement prevents that two linerless labels become stuck together.

The sensor 11 can be realized with different sensor types, for example with a reflective photoelectric barrier.

Figure 5:
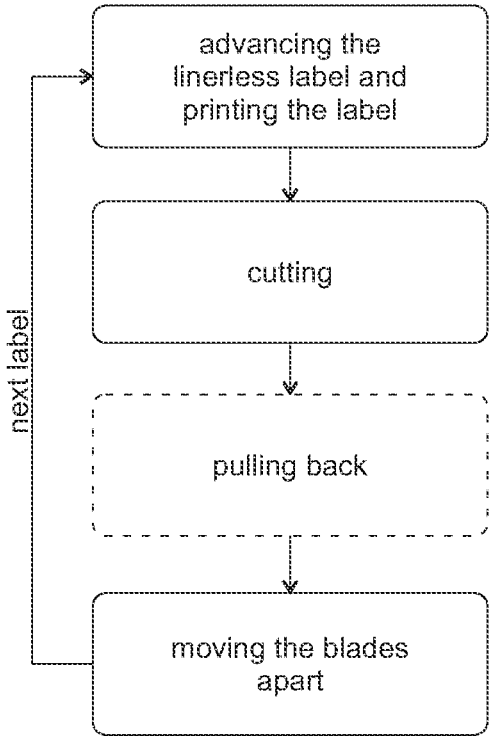
FIG. 5 represents a flowchart with the steps of the method of printing and separating linerless labels for a label printer.

FIG. 5 serves to visualize the method with its steps once more in a flowchart diagram. The step that distinguishes the inventive method, i.e. the pulling back, is represented by a broken line.

Figure 6:
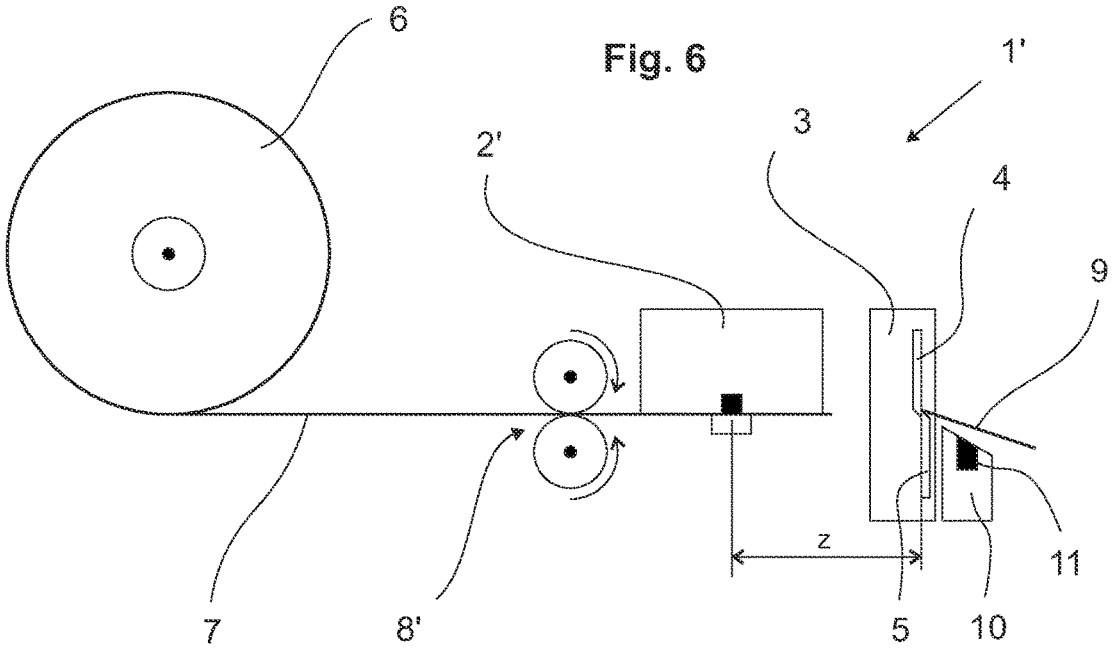
FIG. 6 shows an embodiment of a label printer wherein the paper-feeding unit has two rollers with respectively opposite sense of rotation, in the process step of pulling back the linerless label ribbon from the blades of the cutting unit.

FIG. 6 shows a label printer 1' in the process step of pulling back, wherein the paper-feeding unit 8' has two rollers with respectively opposite sense of rotation. This and other arrangements of the printing unit and the paper-feeding units can likewise be employed to carry out the method according to the invention.

Of course, the method presented here is not limited to applications as label printers for weighing scales, but can also be used with other checking devices where the result of the checking process is documented on a label. It is also possible to employ the method in an automated packaging line where the step of attaching the labels to the checked objects is fully automated.

What is claimed is:

1. A method for printing a linerless label and separating the printed label from a ribbon of the linerless labels, comprising the steps of:

obtaining a printing unit, comprising:

a label printer;

a holder, adapted for holding the ribbon of linerless labels;

a cutting unit, having at least two blades with at least one of the blades arranged on each sides of the ribbon of linerless labels; and a paper-feeding unit;

advancing the ribbon of linerless labels through the printing unit and the cutting unit, using only the paper-feeding unit;

printing on a part of the ribbon of linerless labels during the advancement thereof, using only the printing unit, generating a printed linerless label;

separating the printed linerless label from the ribbon of linerless labels, by closing the blades together;

retracting the ribbon of linerless labels away from the closed blades, using only the paper-feeding unit, generating a gap between the ribbon of linerless labels and the closed blades; and returning the blades to an open condition.

2. The method of claim 1 wherein the blades begin returning to the open position as soon as the ribbon of linerless labels is no longer in contact with the blades.

3. The method of claim 1 wherein the printing unit further comprises a print head, and the gap between the ribbon of linerless labels and the blades is the same as the distance between the print head and the blades.

4. The method of claim 1 wherein the step of separating the printed linerless label is achieved by closing the blades together across the entire width of the ribbon of linerless labels.

5. The method of claim 1 wherein the label printer further comprises a receiving element having a sensor; so that the printed linerless label falls onto the receiving element after being separated from the ribbon of linerless labels and, in response to a signal of the sensor, a next-following linerless label is released for delivery if no linerless label is present on the receiving element (10).

6. The method of claim 5 wherein one of the two blades is statically fixed to the label printer and the other blade is movable.

7. The method of claim 6 wherein the statically fixed blade is positioned such that while the blades are closed, the statically fixed blade is spatially between the movable blade and the receiving element.

8. The method of claim 1 wherein one of the two blades is statically fixed to the label printer and the other blade is movable.

9. The method of claim 8 wherein the movable blade is positioned such that while the blades are closed, the movable blade is positioned on the opposite side of the statically fixed blade where the printed label output is located.

10. A computer-assisted program for the implementation of the method of claim 1 wherein a signal is generated to trigger a pulling-back movement of a linerless label ribbon.

* * * * *